US005832681A

United States Patent [19]

Johnson

[11] Patent Number: 5,832,681

[45] Date of Patent: Nov. 10, 1998

[54] MULL POST

[75] Inventor: Flint Scott Johnson, S. St. Paul, Minn.

[73] Assignee: Flintwood Products, Maplewood, Minn.

[21] Appl. No.: 689,295

[22] Filed: Aug. 7, 1996

[51] Int. Cl.[6] ..... E06B 1/04

[52] U.S. Cl. ..... 52/210; 52/206; 52/211; 52/213; 52/204.55; 52/730.7

[58] Field of Search ..... 52/206, 210, 213, 52/656.1, 656.5, 656.9, 204.5, 204.53, 204.55, 204.68, 211, 730.7, 729.4, 731.5

[56] References Cited

U.S. PATENT DOCUMENTS

| | | | |
|---|---|---|---|
| 2,292,301 | 8/1942 | Smith | 52/210 X |
| 3,000,062 | 9/1961 | McCandless | 52/204.5 X |
| 3,826,053 | 7/1974 | Cameron | 52/656.9 X |
| 4,707,204 | 11/1987 | Heeg | 52/656.1 X |
| 5,138,814 | 8/1992 | Giles et al. | 52/656.1 |
| 5,285,606 | 2/1994 | Hagemeyer | 52/656.9 X |
| 5,450,697 | 9/1995 | Prucinsky et al. | 52/210 |

*Primary Examiner*—Carl D. Friedman
*Assistant Examiner*—W. Glenn Edwards
*Attorney, Agent, or Firm*—Jacobson & Johnson

[57] ABSTRACT

A mull post having an edge surface, a first lateral surface and a second lateral surface with the mull post including a plurality of pocket holes and a plurality of fastener guide passages of sufficient integrity to maintain the axial orientation of a rigid fastener as the fastener is driven at a shallow angle into a frame abutting the mull post to secure the mull post to the frame.

18 Claims, 5 Drawing Sheets

MULL POST

FIELD OF THE INVENTION

This invention relates generally to a mull post and, more particularly, to mull posts for use with assembling of two or more window frames and door frames to provide a rapid, efficient, on-site assembly of the mull post to the frame.

BACKGROUND OF THE INVENTION

The concept of mull posts for use with frames such as window or door frames is known in the art. Typically, the mull posts extends between two adjacent frames to provide lateral support for the frames located adjacent to the mull posts. In order to fasten the mull posts to the frame member, nails are driven perpendicularly or diagonally through the frame and into the mull posts. When mull posts are used with ready-to-install window frames, in some cases it is necessary to first remove the sash stops from the window frame and than secure the frame to mull post with a fastener such as a nail or the like, which is driven laterally or diagonally through the frame and into the mull post. Once the frame is secured to the mull posts, the sash stop is replaced on to the window frame.

This is a time consuming process as it requires the worker to not only remove the sash stop, but to replace the sash stop after the frame has been secured to the mull post. Unfortunately, the shallow angle needed to drive a nail into the mull post and into the frame can result in either the nail penetrating through the frame or the nail failing to properly enter the frame. In either case the result is undesirable. The present invention comprises a method for rapidly assembling a mull post and frame without having to disassemble and reassemble the window frame. The present invention includes a mull post carrier that enables one to fasten the mull post directly to the frame without having to reassemble the sash stops. In contrast to mull posts of the prior art, the mull posts of the present invention include a plurality of pocket holes and fastener guide passages located entirely in the mull post, with the pocket holes and fastener guide passages extending from the inside edge surface to the lateral surfaces of the mull post at a shallow angle, with the guide passage having sufficient integrity so that when a rigid fastener is brought into engagement with the guide passages, the integrity of the guide passages is sufficient to maintain the angled orientation of the fastener to enable the fastener to penetrate the frame at a desired shallows angle.

SUMMARY OF THE INVENTION

Briefly, the invention comprises an improved mull post and method of fastening a mull post to lateral frames with the mull post carrying a plurality of spaced fastener holes, with the fastener holes extending in a diagonal manner from an edge surface of the mull post and projecting through the lateral surface of the mull post at a shallow angle to form a plurality of shallow diagonal engagement guides that permit the precise placement of fasteners in the mull posts and into the frame without splitting the frame or the mull post, while eliminating the need to remove and replace the stops on the frame when the mull posts are attached to the frame. The fasteners are of sufficient length so that when the head of the fasteners engages an internal shoulder in the pocket holes, the fasteners project sufficiently far out so as to engage a sufficient portion of the frame so that the fasteners hold the frame and mull post in stable position. The fasteners have sufficient rigidity so as to engage and penetrate the frame even though the fasteners enter the frame at a shallow angle.

A fastener guide passage has sufficient integrity to maintain the axial orientation of the fastener as the fastener is driven into the frame. To enable the mull post to be handled freely without injury to the person or damage to other articles, the fasteners are sufficiently short so that the length of the pocket hole and guide hole through the mull posts is greater than the length of the fastener to enable the fasteners to be protectively carried in a ready to use condition within the mull post.

DESCRIPTION OF THE PREFERRED EMBODIMENT

Figure 1:
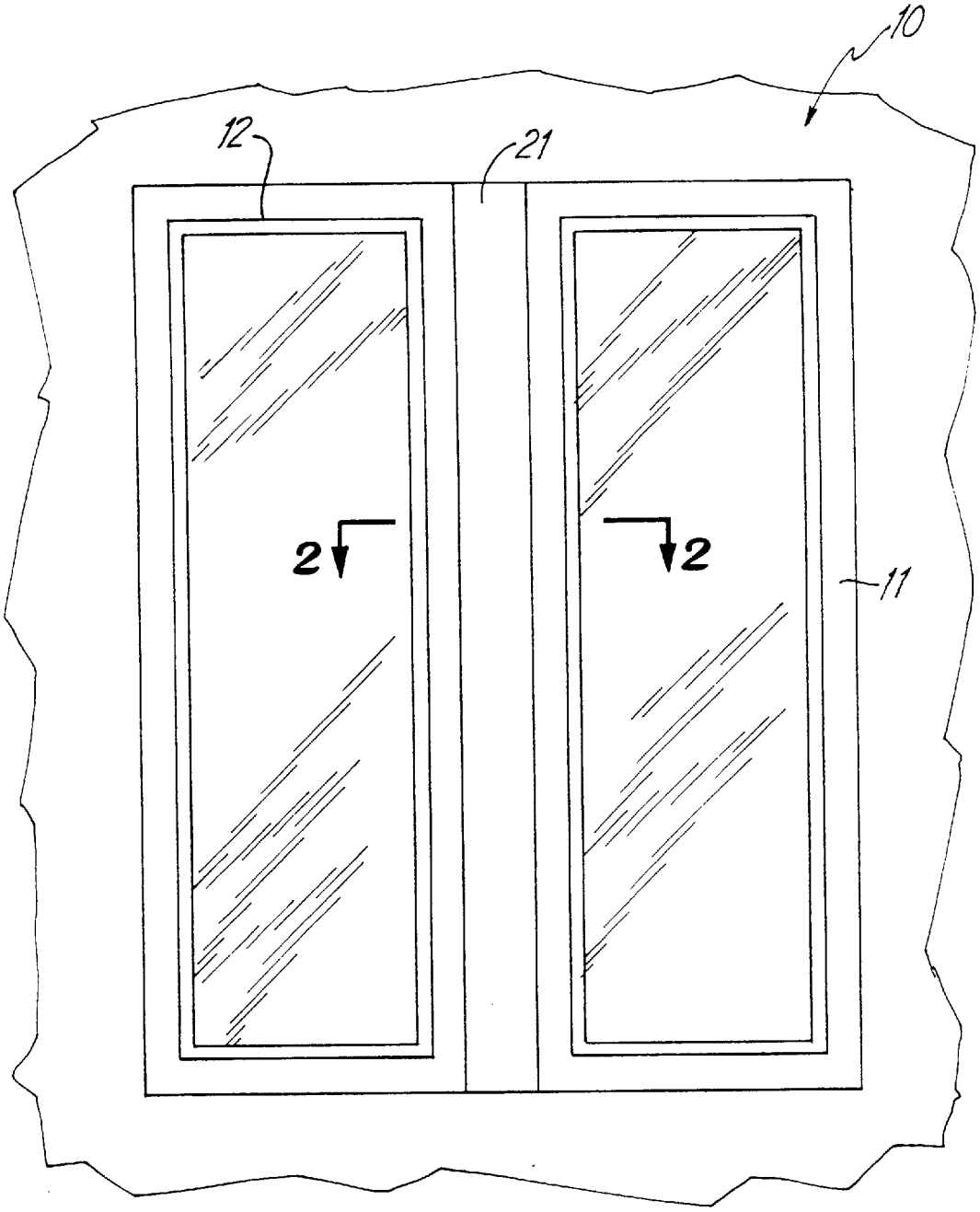
FIG. 1 shows a portion of a building with a pair of window frames positioned on each side of a mull post.

FIG. 1 shows a portion of a building 10 with a pair of window frames 11 and 12, positioned on opposite sides of a mull post 21.

Figure 4:
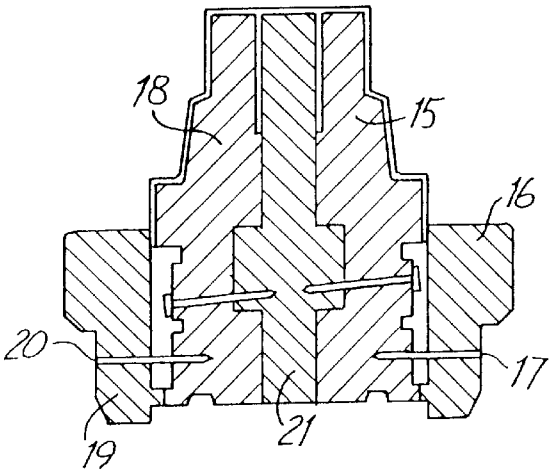
Fig. 4 PRIOR ART
FIG. 4 shows the prior art step of reattachment of the mull posts to the window frame after the window frame is secured to the mull post.
Figure 3:
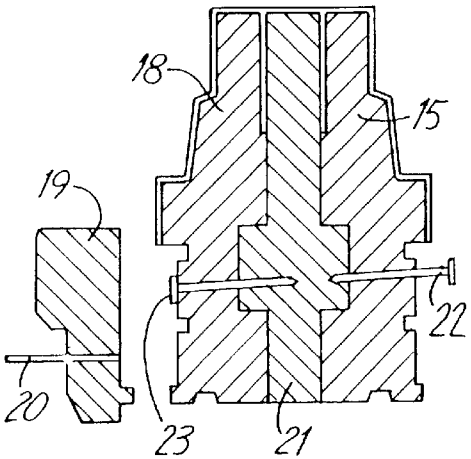
Fig. 3 PRIOR ART
FIG. 3 shows the prior art step of removal of the sash stops to permit the fastening of the window frames to the mull post.
Figure 2:
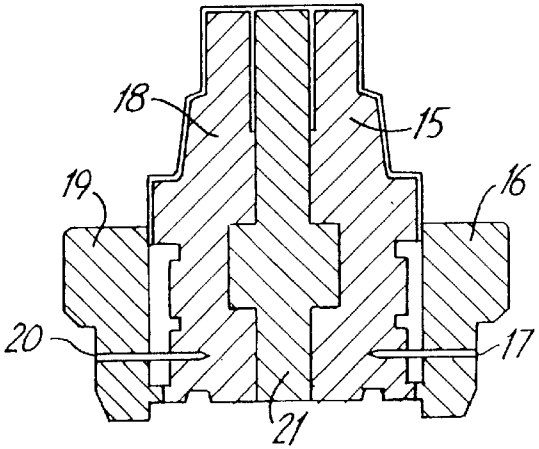
Fig. 2 PRIOR ART
FIG. 2 shows a sectional view of a prior art mull post and window frames positioned next to each other for assembly of the window frames to the mull post.

FIGS. 2 through 4 illustrate how conventional mull posts are fastened to lateral frames by nailing the frame to the mull post. FIG. 2 shows a first frame member 15 having a sash stop 16 secured to frame member 15 with a fastener such as a nail 17. Similarly, a second frame member 18 has a second sash stop 19 which is secured to frame member 18 with a fastener such as a nail 20. In the condition shown in FIG. 2, mull post 21 is positioned between the frames 15 and 18 but has not yet been attached to the frames 15 and 18. FIG. 3 shows the start of the process of attaching mull post 21 to the frame. Note, the second stop 19 is removed from the frame member 18 and sash stop 16 (not shown) is removed from frame member 15, that is, the frames 15 and 18 are shipped with the sash stops secured to the frame, and must be removed in order to hasten the frames 15 and 18 to the mull post 21. When the sash stops 16 and 19 are removed, a fastener 23 can be driven through frame 18 and into mull post 21. Similarly, a fastener 22 can be driven through frame 15 and into mull post 21. After the fasteners have been driven though the frame members 15 and 18, the sash stops 16 and 19 can be replaced. FIG. 4 shows sash stop 19 being replaced and reattached with fastener 20 extending into frame member 18. Similarly, sash stop 16 has been replaced and reattached with fastener 17 extending into frame member 15 to hold frame member in position against mull post 21.

In the prior art process, the mull post 21 acts as a passive receiver for the fasteners 22 and 23. In the present invention, the fastening process is reversed with the fasteners extending into portions of the frame after having first penetrated the mull post. It has been found that the process by using the mull post as a fastener carrier and fastener guide allows one to quickly fasten the mull post to the frame without fear of damaging the frame.

Figure 5:
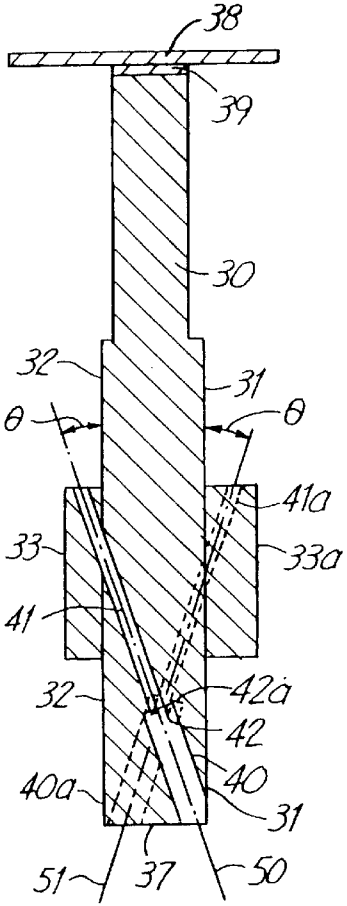
FIG. 5 shows a mull post of the present invention without any fasteners therein.

FIG. 5 shows a sectional view of the mull post 30 of the present invention. Mull post 30 includes a first lateral surface 31 and a second lateral surface 32. A tongue 33*a* extends outward from lateral surface 31 and similarly a tongue 33 extends outward from lateral surface 32. Located on one edge of mull post 30 is an adhesive 39 that secures a winged cap 38 thereto. Cap 38 forms the outside edge of the mull post 30, and can be used to cover the seams between the frame and the mull post 30. Located on the opposite edge of the mull post 30 is an interior edge surface 37. Positioned on one side of edge surface 37 is a first pocket or shoulder hole 40 extending inward from edge surface 37 and terminating with a shoulder 42. Extending from shoulder 42 is a cylindrical fastener guide passage 41 that extends though the lateral surface 32 and tongue 33. Similarly, Positioned on the opposite side of edge surface 37 is a second pocket or shoulder hole 40*a* extending from edge surface 37 and terminating with a second shoulder 42*a*. Extending from shoulder 42*a* is a cylindrrical guide passage 41*a* that extends though the lateral surface 31 and the tongue 34. Cylindrical fastener guide passages 41 and 41*a* are characterized by having sufficient integrity so as to maintain the axial orientation of a fastener therein as the fastener makes angled penetration of a frame member. That is, a rigid fastener driven though the guide passages will maintain its orientation even though substantial side forces will be present on the tip of the fastener as the fastener enters the frame at a shallow angle.

FIG. 5 shows a first center line 50 extending in a diagonal manner through the interior edge surface 37 and lateral surface 32 and a second center line 51 extending in a diagonal manner through edge surface 37 and lateral surface 31 and tongue 34. In the embodiment shown, the center lines make a shallow angle of about 15 degrees with the lateral surface. In order to have the fasteners penetrate the frame at a shallow angle, the guide passages in the mull post 30 should have sufficient integrity so as to maintain the axial orientation of the screw fastener as the screw is driven into the frame. It will be understood that integrity of the guide passage will be affected by the length of the guide passage, as well the type of materials used in construction of both the frame and the mull post. That is, with harder woods in the frame, a greater holding force or greater integrity of guide passages is required to maintain the axial orientation of the fastener as it is driven at an angle into the frame. It has been found that with shallow angles on the order of about 15 degrees, placement of a plurality of fasteners that extend diagonally into only a portion of the frame is sufficient to secure the frame to the mull post. That is, with a plurality of fasteners engaging only a portion of the frame, it is sufficient to hold the frame in position against the mull post.

Figure 7:
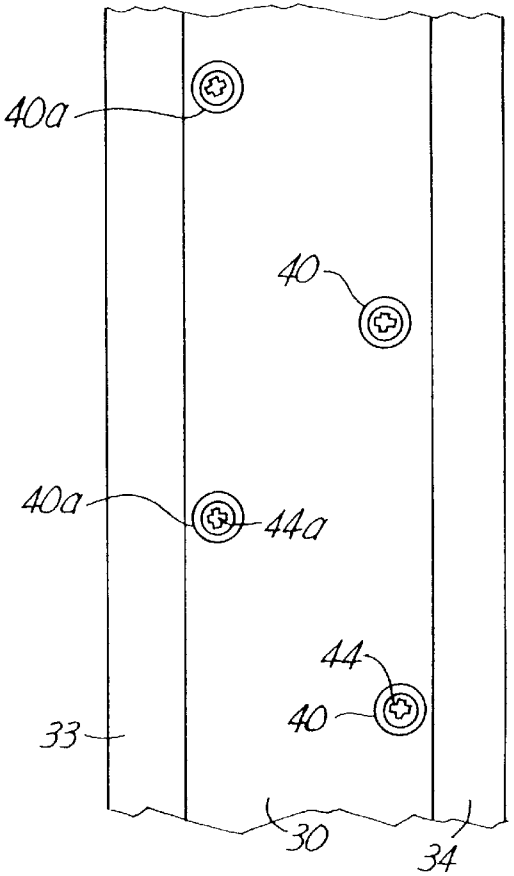
FIG. 7 shows a portion of an edge view of the mull post with a plurality of fasteners carried by the mull post to permit rapid engagement of the mull posts with the frames.

FIG. 7 shows an edge view of mull post 30 illustrating that shoulder holes 40 and 40*a* are located in staggered and spaced arrangement lengthwise along elongated mull post 30.

Figure 6:
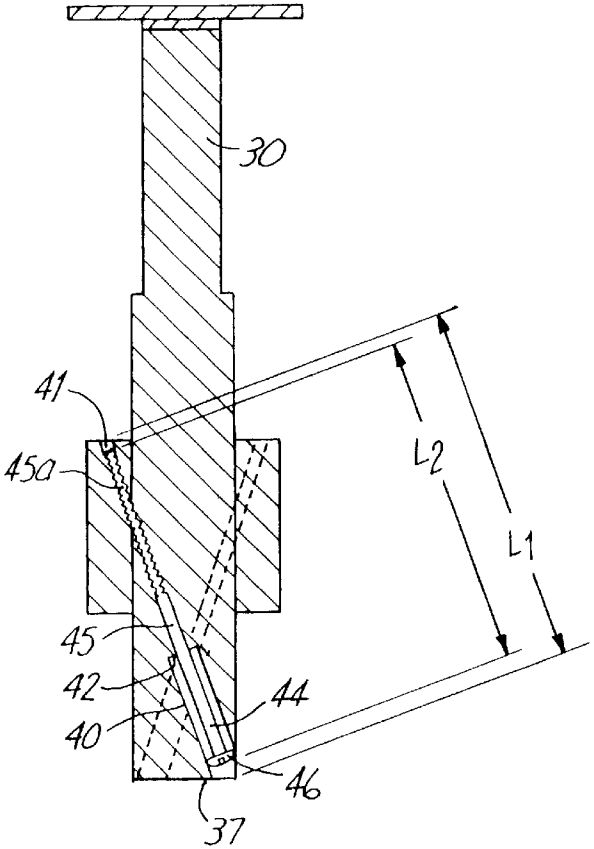
FIG. 6 shows the mull post of FIG. 5 with the mull post carrying a fastener therein, the fastener extending in a diagonal manner from an edge surface of the mull post through a lateral surface on the mull post.

FIG. 6 illustrates a screw fastener 44 of length $L_2$ located in shoulder hole 40 of length $L_1$ with fastener 44 including a head 46 and a shank 45 with a threaded portion 45*a* extending through cylindrical passage 41. In the embodiment shown, fastener 44 is sufficiently short so as be retained in mull post 30 without either end of fastener protruding therefrom. In this condition, the mull post 30 with a fastener therein can be handle without danger of the fasteners causing damage to finished surfaces they might come into contact with. On the other hand, fastener 44 is sufficiently long so that when head 46 is in engagement with shoulder 42, the threaded portion 45*a* projects sufficiently far so as to firmly engage an adjoining frame member and hold the frame member in position. The actual projection distance of the screw fastener can be determined by the type of material in the frame as well as the thickness and size of the frame. One of the features of the present invention is that for certain applications one length screw fastener can be used and for other applications screw fasteners of a different length can be used without having to alter or change the shoulder and fastener guide passages in the mull post.

In the embodiment shown in FIG. 6, the screw fasteners are held in position within the pocket holes through engagement between the screw fastener and the side walls of the passages and pocket holes in the mull posts. In applications where one wants to quickly assemble the mull post to the frame, the screw fasteners can be frictionally held within the mull posts. In other applications, the screw fasteners can be extended into the pocket holes during the on-site assembly process.

Figure 8:
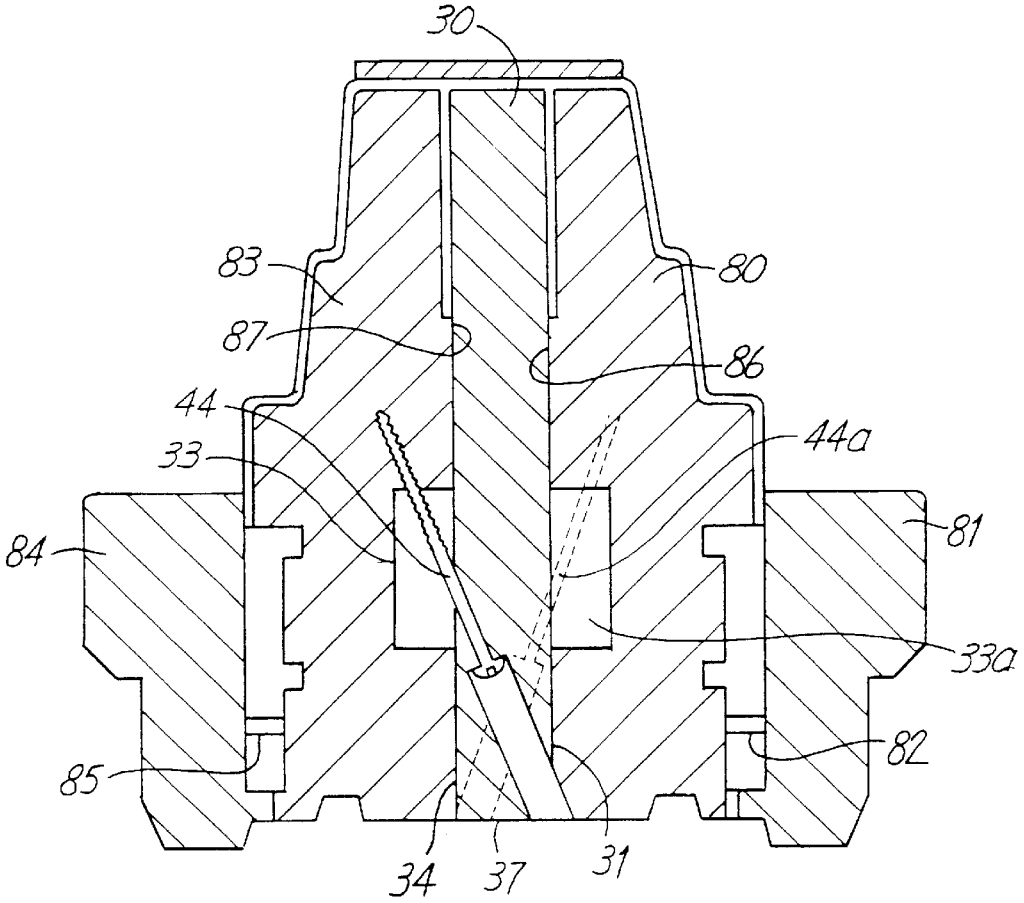
FIG. 8 shows a sectional view of the mull post of the present invention secured to lateral frames without the use of lateral fasteners extending through the frame and into the mull post.

FIG. 8 shows a cross-sectional view of a frame assembly with a first frame 80 and a second frame 83 with frame 80 having a lateral surface 86 and frame 83 having a lateral surface 87. Extending between frames 80 and 83 is mull post 30 having an interior edge surface 37, with the mull post 30 having a first lateral surface 31 engaging lateral surface 86 on frame 80. Similarly, mull post 30 has a second lateral surface 34 engaging the lateral surface 87 on second frame 83. The mull post 30 carries a first plurality of screw fasteners 44 having a central axis extending in a diagonal manner though edge surface 37 and lateral surface 31 and a second plurality of screw fasteners 44*a* having a central axis extending in a diagonal manner though edge surface 37 and lateral surface 32. The screw fastener 44 includes a first end carried by and engaging the mull post 30, and a second end of the fastener engaging first frame 80. Similarly, the fastener 44*a* includes a first end carried by and engaging the mull post 30, and a second end of the fastener 44*a* engaging second frame 83. In this embodiment mull post 30 has first lateral surface 31 and tongue 33 engaging the lateral surface 87 and a groove on second frame 83 and second lateral surface 31 engaging the lateral surface 86 and a groove on second frame 80.

FIG. 8 shows mull post 30 carrying screw fasteners 44 and 44*a*, each having a central axis extending in a diagonal manner though the edge surface 37 and into engagement with the lateral surfaces of the frame.

The mull post 30 has a central axis which forms a minimum angle of about 15 degrees to mull posts lateral surface 31 or 32. FIG. 8 shows the mull post pocket holes 40 and 40*a* have shoulder holes extending in a criss-crossing pattern through mull post 37, and FIG. 7 shows that pocket holes 40 and 40*a* are alternately spaced from each other along opposite outer portions of the edge of mull post 30.

Figure 9:
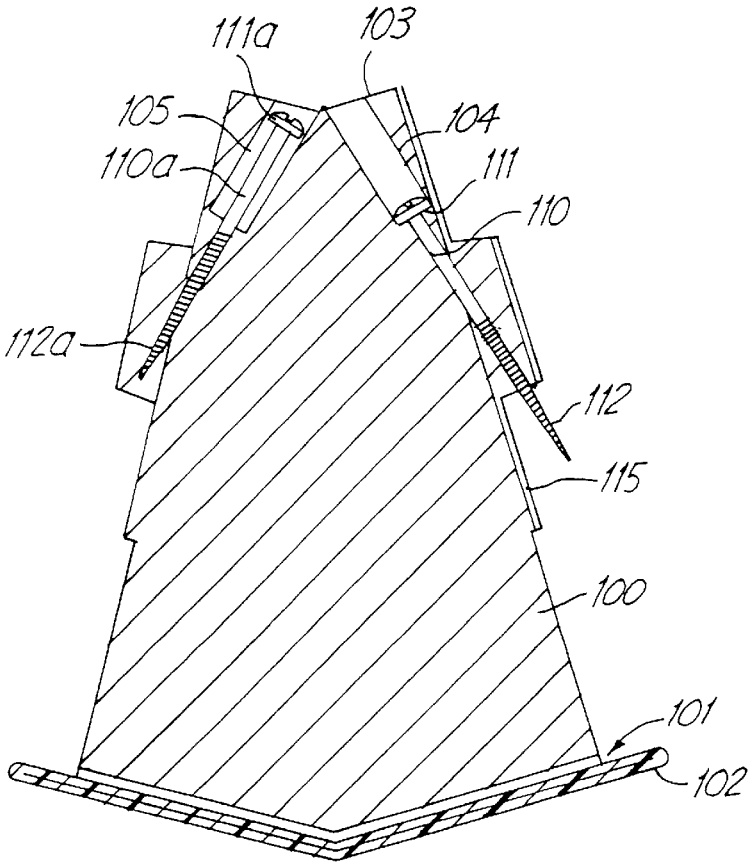
FIG. 9 shows another mull post of the present invention for securing to lateral frames without the use of lateral fasteners extending through the frame and into the mull post.

FIG. 9 shows an alternate embodiment of a mull post 100 for use in bay widows or the like. In mull post 100, an adhesive 101 holds a cap 102 on one edge of mull post 100. The opposite edge 103 of mull post 100 includes a first shoulder hole 104, and a second shoulder hole 105. Shoulder hole 104 includes a threaded fastener 110 having a head 111 and a threaded edge 112. Similarly, shoulder hole 105 includes a threaded fastener 110*a* having a head 111*a* and a threaded edge 112*a*. The embodiment of FIG. 9 is similar to the embodiment of FIG. 8 except that the shoulder holes do not extend diagonally across the edge surface 103. That is, the axis of fastener 110 forms a relatively shallow angle of about 15 degrees or less with lateral surface 115.

Figure 10:
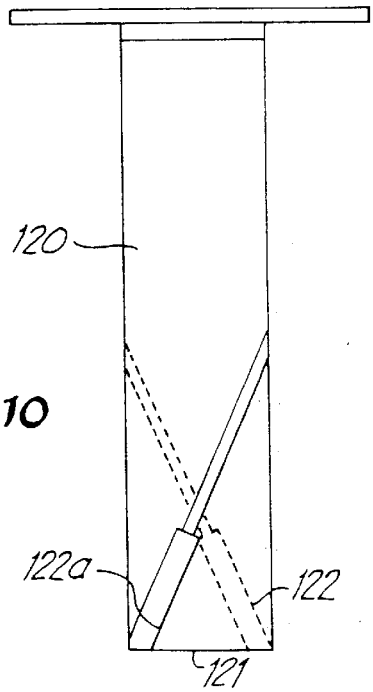
FIG. 10 shows an alternate embodiment of a mull post.

FIG. 10 shows a further alternate embodiment of mull post with mull post 120 having a generally rectangular shape free of any tongues. Located on the edge of mull post 120 is edge surface 121 with two shoulder holes 122 and 122*a* for holding fasteners therein.

The mull posts of the present invention can be made of wood or composite materials such as Timberstrand material as long as the mull post guide passages have sufficient integrity to maintain the orientation of a threaded fastener as it is driven into an adjoining frame.

I claim:

1. A frame assembly comprising:

a first frame and a second frame each having a lateral surface;

a mull post having an edge surface, said mull post having a first lateral surface engaging the lateral surface on said first frame, said mull post having a second lateral surface engaging the lateral surface on said second frame, said mull post carrying a first rigid fastener having a central axis extending in a diagonal manner though said edge surface and said first lateral surface with a first end of said first fastener carried by and engaging the mull post and a second end of said fastener engaging said first frame to hold said first frame thereto, said mull post carrying a second rigid fastener having a central axis extending in a diagonal manner though said edge surface and said second lateral surface with a first end of said second fastener carried by and engaging the mull post and a second end of said fastener engaging said second frame to hold said second frame thereto, said mull post including a fastener guide passage with integrity to maintain the orientation of the first rigid fastener driven through the mull post and into said first frame member.

2. The mull post of claim 1 wherein the first rigid fastener has a first length and the fastener guide passage has a second length with the length of said first rigid fastener equal to or less than the second length to enable the mull post to carry said first rigid fastener therein without the first rigid fastener protruding therefrom.

3. The mull post of claim 2 wherein said first rigid fastener is a screw fastener having a threaded section with a pointed end therein for pulling said screw fastener into said mull post as said screw fastener is rotated about a longitudinal axis of the screw fastener.

4. The mull post of claim 3 wherein said first rigid fastener is held in said mull post through engagement with a sidewall of said guide passage in said mull post.

5. The mull post of claim 4 wherein said mull post includes tongues for engagement with groves.

6. The mull post of claim 5 wherein said central axis forms a minimum angle of about 15 degrees to said first mull post lateral surface.

7. The mull post of claim 6 including a set of pocket holes alternately spaced from each other along an outer portion of said edge of said mull post.

8. The mull post of claim 7 wherein each of the mull post pocket holes have guide passages extending in a criss-crossing pattern through said mull post.

9. The mull post of claim 8 wherein the pocket holes and the guide passages are cylindrical.

10. The mull post of claim 9 wherein the mull post includes a wing cap.

11. The mull post of claim 10 wherein the wing cap is adhesively fastened to said mull post.

12. The method of assembling a frame to a mull post comprising the steps of:

placing a mull post having an edge surface and a lateral surface in a first position;

placing a frame adjacent said lateral surface of said mull post;

forming a fastener guide passage in said mull post that extends in a diagonal manner from said edge surface toward said lateral surface;

extending a rigid fastener sufficiently far into said frame using the fastener guide passage to maintain a shallow penetration angle of the fastener as the fastener is extended into the frame to thereby secure the frame to the mullpost.

13. The method of claim 12 including the step of forming a shoulder in the mull post to support of a head of the fastener thereon.

14. The method of claim 13 including the step of forming the fastener guide passage with a central axis that is about a minimum of 15 degrees to the lateral surface.

15. The method of claim 14 including the step of forming multiple guide passages in a criss-crossing pattern in an inside edge of said mull post.

16. The method of claim 15 including the step of adhesively bonding a wing cap to an outside edge of the mull post.

17. The frame assembly of claim 1 wherein said first rigid fastener and said second rigid fastener are screw fasteners.

18. The frame assembly of claim 1 including a plurality of fastener guide passages wherein the fastener guide passages extend through said mull post in a criss-crossing pattern.

* * * * *